United States Patent [19]

McNeirney et al.

[11] Patent Number: 4,727,985

[45] Date of Patent: Mar. 1, 1988

[54] MIXING AND DISPENSING APPARATUS

[75] Inventors: John McNeirney, Madison, Wis.; Charles Huck, Pottersville, N.J.

[73] Assignee: The BOC Group, Inc., Montvale, N.J.

[21] Appl. No.: 832,204

[22] Filed: Feb. 24, 1986

[51] Int. Cl.[4] ..... B65D 25/08

[52] U.S. Cl. ..... 206/221; 215/DIG. 8

[58] Field of Search ..... 206/221, 219, 222; 215/DIG. 8; 222/145

[56] References Cited

U.S. PATENT DOCUMENTS

| | | | |
|---|---|---|---|
| 2,275,567 | 3/1942 | Smith | 206/221 |
| 2,689,566 | 9/1954 | Lockhart | 206/221 |
| 3,070,094 | 12/1962 | Sarnoff et al. | 206/221 |
| 3,439,823 | 4/1969 | Morane | 206/221 |
| 3,464,414 | 9/1969 | Sponnoble | 206/221 |
| 3,467,097 | 9/1969 | Ogle | 206/221 |
| 3,651,990 | 3/1972 | Cernei | 206/221 |
| 4,122,943 | 10/1978 | Silver et al. | 206/221 |
| 4,234,083 | 11/1980 | Cohen | 206/221 |
| 4,315,570 | 2/1982 | Silver et al. | 206/221 |
| 4,331,233 | 5/1982 | Braymer, Jr. | 206/221 |

*Primary Examiner*—Joseph Man-Fu Moy

*Attorney, Agent, or Firm*—Chris P. Konkol; Larry R. Cassett

[57] ABSTRACT

A bottle (12), which has a single circular opening (12*f*) at the top (12*e*), contains a liquid (32) in a bottom chamber (12*h*) and a powder (26) in an upper chamber (12*d*). A rubber stopper (14) exists in a neck chamber (12*g*) between the upper (12*d*) and lower (12*h*) chambers and isolates the liquid (32) from the powder (26). The neck chamber (12*g*) has a smaller cross-sectional area than the lower chamber (12*h*). A cylindrical basket (16) with openings in the side walls (16*a*) sits on top of the rubber stopper (14). A cylindrical rubber dispenser plunger (18) having a sealing portion (18*a*) sits above the basket (16). A locking cap (22) sits on top of the dispenser plunger (18). A septum cap (24) having vent holes (24*c*) sits on top of the locking cap (22). A sealing disc (26) sits on top of the septum cap (24). A cup-like top cap (28) covers the top of the bottle (12). Shrink wrap (32) adheres to the top cap (28) and part of the outside of the bottle (12).

16 Claims, 7 Drawing Figures

MIXING AND DISPENSING APPARATUS

FIELD OF INVENTION

This invention relates to apparatus which facilitates the separate containing and then mixing of two ingredients and in particular the separate containing and then mixing of a powder and a liquid.

BACKGROUND OF THE INVENTION

Many drugs are mixed with a diluent before being delivered to a patient because the mixture tends to be unstable. The diluent may be, for example, a dextrose solution, a saline solution or water. Many such drugs are supplied in powder form. Thiopental sodium and water solutions for injection need to be mixed in a sterile manner promptly before use with unused portions discarded within 24 hours.

Liquid from a first container may be mixed with a powder compound in a second container by inserting a needle-like hollow conduit which is coupled to the first container through a sealing diaphragm of the second container. Examples of this type of apparatus are illustrated and described in U.S. Pat. Nos. 4,392,850 and 4,392,851, 3,882,909, and 4,336,802. One problem with this approach is that mistakes can be made and the wrong liquid and powder can be combined. Another problem is that there can be a mishap and sterile conditions can be lost. Still another problem is that the process is somewhat complicated. Furthermore, the wrong proportions of liquid and/or powder can be combined.

U.S. Pat. No. 4,331,233 illustrates and describes a two-compartment vial with a plug sealingly seated in a constricted portion which selectively separates and isolates powder stored in a lower chamber from liquid stored in an upper chamber. A flexible stopper fits in an opening at the top of the vial and extends into the vial. Pushing down on the stopper causes a force to be exerted on the liquid which in turn exerts a force on the plug that dislodges the plug and causes it to be displaced into the lower chamber. This allows liquid in the upper chamber to flow into the lower chamber and mix with the powder. One problem with this vial is that it is difficult to get the powder into the lower chamber without getting some of it on the walls of the upper chamber. When the liquid is poured into the upper chamber it activates with the powder on the side walls of the upper chamber. This premature mixture of improper proportions, which can degrade with time, can destroy the purity of the mixture subsequently formed. One solution to this problem could be to clean the upper chamber after the lower chamber is filled and the plug is inserted. This adds to the cost and complexity of manufacture. Another problem of manufacture is that it is not easy to insert the plug into a sealing position since nothing is connected to the plug. Another problem is that if the amount of liquid does not completely fill up the upper chamber then there is an air pocket which must be compressed before the force applied to the top stopper is transmitted to the liquid and then to the plug. The changing of the locations of the powder and liquid leads to a potentially more difficult operation since some powders compress under pressure and accordingly, more force must be applied to dislodge the plug.

A drug known as topicycline (tetracycline hydrochloride for topical solution) is produced for Proctor & Gamble and is sold in mixing and dispersing apparatus. The apparatus, which includes a glass bottle containing liquid and having a threaded top portion that defines an opening therein, a stopper, a screw-on cap, and an applicator which contains powder medication, allows the liquid and the powder to be mixed in the bottle. As taken from the provided package, the bottle is partly filled with a liquid which is 40% ethanol, citric acid and n-decyl methyl sulfoxide. It has a stopper inserted into the opening at the top and has the cap screwed onto the top of the bottle. The cap is first removed and then the stopper is removed and discarded. The applicator, which is packaged in what appears to be a sealed sterile wrapping, is removed from the wrapping and inserted into the top of the bottle. Within a chamber of the applicator there is contained a powder which is tetracycline hydrochloride, 4-epitetracycline hydrochloride, and sodium bisulfite. The applicator is cylindrical, has a semi-spherical flexible top member, a piston member, and an ejectable cylindrical bottom sealing member. The piston member engages the top and bottom members of the applicator and is displaced when the top member is pressed such that the sealing bottom member is discharged from the applicator and falls into the liquid in the bottle. The powder in the chamber then falls into and mixes with the liquid. The top member has a series of apertures therethrough which permits the mixture to be applied to the skin after the cap is removed. One problem with this apparatus is that the mixing operation is not sterile since the bottle is open to the air and the applicator must be handled and therefore can be contaminated by air borne contaminants or by contaminants on the hands of a preparer of the mixture. It is also possible that if different applicators and bottles are stored together that the wrong applicator and bottle might be combined.

It is desirable to have apparatus in which a powder and a liquid can be mixed in such a manner that sterile conditions are maintained, the proportions of the two ingredients being mixed are always correct, nothing can leak out, and the process is simple, easy to perform, and essentially fool proof.

Summary of Invention

The present invention is directed to apparatus adapted to separately contain and mix a liquid and a solid in a sterile operation which is simple, efficient, relatively fast, and essentially fool proof. In a general form the apparatus comprises a container comprising first and second chambers which are adapted to house first and second ingredients, respectively, sealing means for forming a sealing engagement with an internal surface of the container intermediate the first and second chambers to form a barrier between said chambers, and displacing means selectively in contact with the sealing means for selectively causing the sealing means to be displaced into the first chamber so as to allow the two chambers to communicate one with the other and thus allow a mixing of a first ingredient which may be housed in the first chamber with a second ingredient which may be housed in the second chamber.

In a preferred embodiment the first ingredient is a powder, the second ingredient is a liquid, the sealing means is a rubber stopper, and the displacing means comprises a dispenser plunger having vents therethrough and a basket. The apparatus further comprises a neck chamber which is intermediate between the first and second chambers, a locking crown having vents therethrough, a septum cover having vents therethrough, a vent cover, a locking cap, and shrink wrap. Liquid is first poured into the second chamber of the container. The basket is fastened to the stopper. The basket-stopper combination is then placed in the container with the stopper forming a sealing engagement with side walls of the neck chamber and the basket sitting essentially in the first chamber. Powder is then poured into the first chamber and an assembly comprising the dispensing plunger, filter, and locking crown is then placed in the first chamber. The locking crown is then placed over the dispensing plunger. The septum cap is then placed over the locking crown and the sealing disc is placed on the septum cap. The locking cap is then placed over the sealing disc, the septum cap, and the locking crown. Shrink wrap is placed over the locking cap and part of the container and is then heated so as to cause the shrink wrap to closely adhere to the locking cap and container.

In a mixing and dispensing operation the shrink wrap and locking cap are first removed and a force is applied to the septum cap to force it, the locking cap, the dispenser plunger, the basket, and the sealing means towards the second chamber until the sealing means is completely within the second chamber. The powder then falls into the liquid and begins to mix. The container is then shaken to completely mix the powder and liquid. The needle tip of a syringe is inserted through the septum cap and into the first chamber. The container is then turned such that the first chamber is below the second chamber and the mixture is drawn from the container.

The container structure of the present invention facilitates a mixing and dispensing operation which is sterile, efficient, relatively quick, and essentially fool proof.

These and other features and advantages of the invention will be better understood from consideration of the following detailed description taken in conjunction with the accompanying drawings.

DETAILED DESCRIPTION

Figure 1:
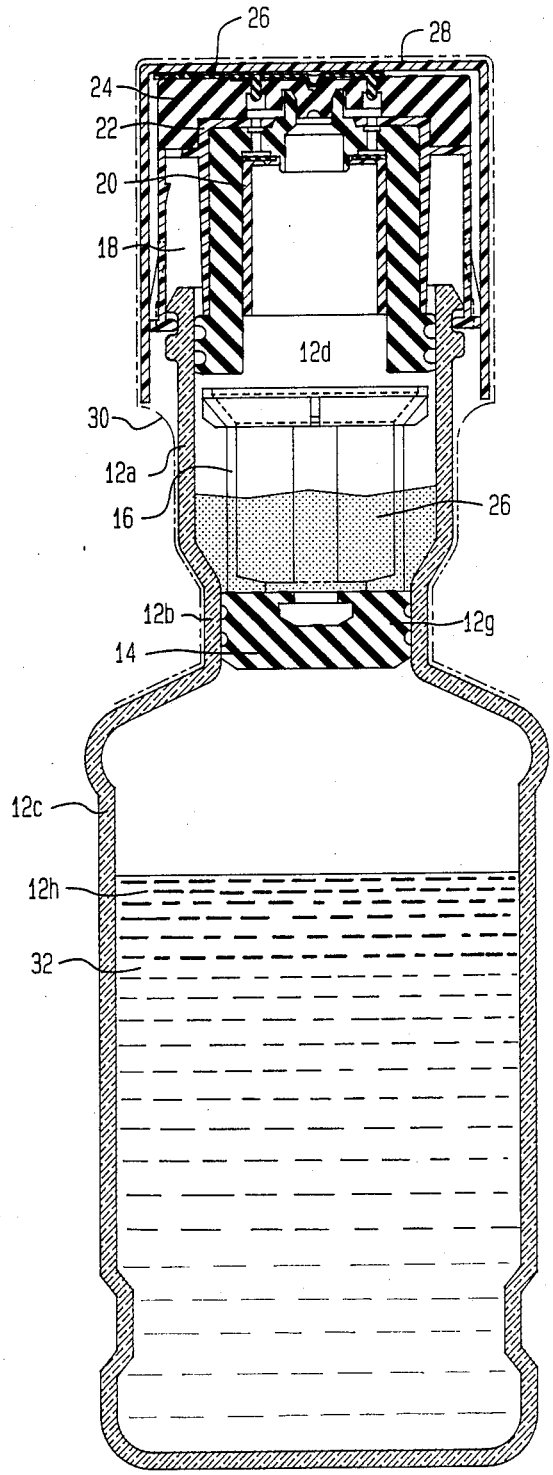
FIG. 1 illustrates a cross-sectional view of one embodiment in accordance with the present invention.
Figure 3:
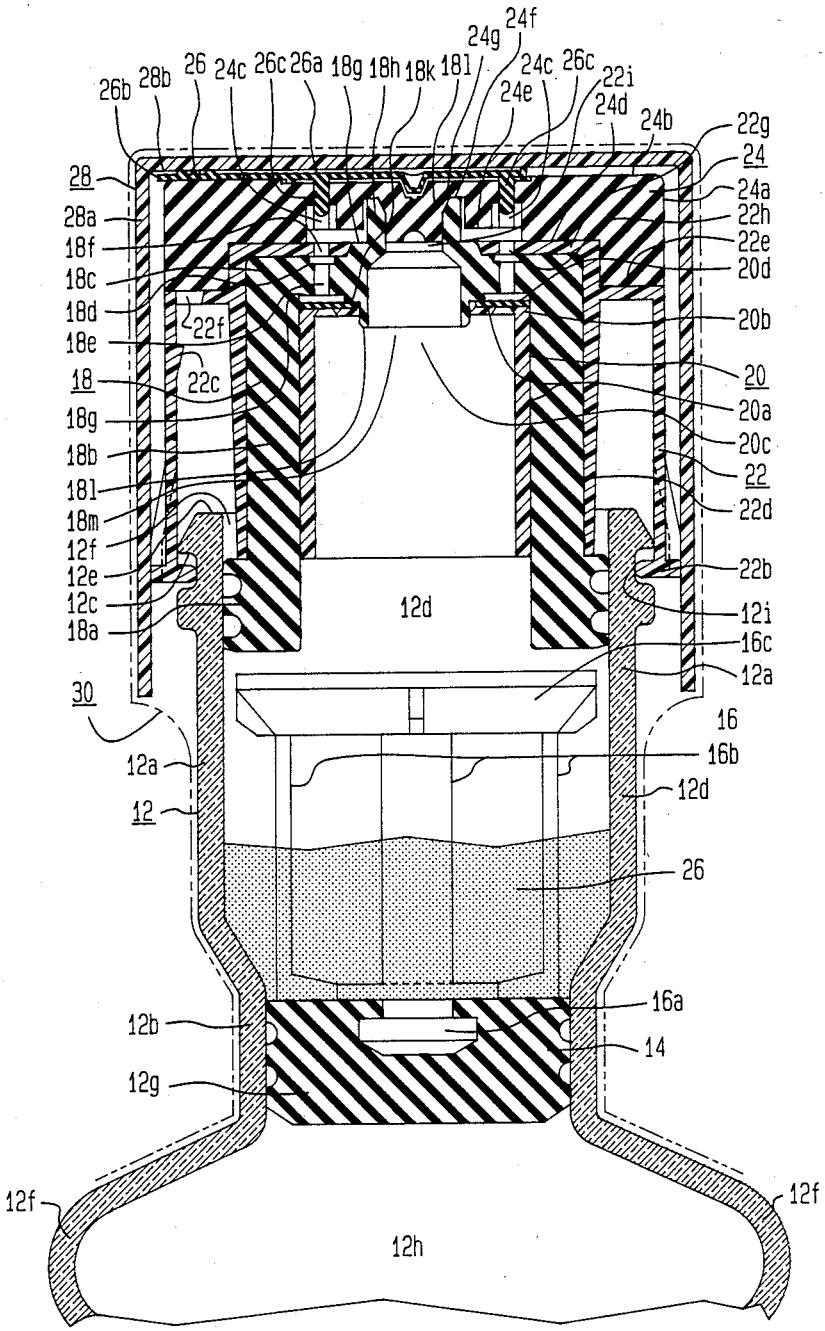
FIG. 3 illustrates a fragmentary cross-sectional view of a portion of the embodiment of FIG. 1.

Referring now to FIGS. 1 and 3, there is illustrated a cross-sectional view of mixing and dispensing apparatus 10 which comprises a container 12, a liquid stopper 14, a basket 16, a dispenser plunger 18, a filter assembly 20, a locking crown 22, a septum cap 24, a sealing disc 26, a locking cap 28, and shrink wrap 30. Container 12 is typically a glass bottle having side walls **12*a*, 12*b*, and 12*c*. Side walls 12*a* define an upper chamber 12*d* that terminates at a top portion 12*e*. Portion 12*e* defines an opening 12*f* that is in direct communication with upper chamber 12*d*. Side walls 12*b* define a neck chamber 12*g* and side walls 12*c* which define a lower chamber 12*h*. Top portions of an exterior side wall of 12*a* define a groove 12*i*. Liquid 32 is illustrated partly filling the lower chamber 12*h*. Basket 16 is illustrated containing a powder compound 26 and being located in essentially upper chamber 12*d***.

Liquid stopper 14, which may be referred to as a sealing means or an isolation means, has a plurality of spaced annular ridges therearound and is preferably fabricated from a resiliently flexible material that is impervious to the powder or liquid stored in apparatus 10. When in the position illustrated, liquid stopper 14 is sealingly seated against side walls **12*b*. This isolates the upper chamber 12*b* from lower chamber 12*h* and thus isolates powder 26 from liquid 32**.

The configuration of container 12, wherein the upper, lower, and neck chambers, and the top opening are all substantially coaxially aligned, is conventional and permits container 12 to be manufactured using a standard glass-blowing process well known in the art.

Basket 16 comprises a male fastener portion **16*a*, rib portions 16*b*, and a collar portion 16*c*. Male fastener portion 16*a* is adapted to be inserted into a cavity of stopper 14 and to be held in place by portions of stopper 14. The fastening of basket 16 to stopper 14 facilitates the insertion of stopper 14 into chamber 12*g* in that basket 16 acts as a handle. Another function of basket 16 is to transmit force applied from dispenser plunger 18 to liquid stopper 14. Collar portion 16*c* is tapered so as to be able to nest against bottom portions of side walls 12*a* and thus prevents basket 16 from falling completely into lower chamber 12*h***.

Dispenser plunger 18 comprises a cylindrical sealing portion **18*a*, a cylindrical body portion 18*b*, a cylindrical top portion 18*c*, and a circular recessed upper top flat portion 18*d* which defines an aperture 18*e* therethrough. Dispenser plunger 18 is preferably fabricated from resiliently flexible material that is imprevious to the liquid or powder stored in apparatus 10. Dispenser plunger 18 and basket 16** may be referred to or denoted as displacing means.

Circular portion **18*c* surrounds circular portion 18*d*. Portion 18*a*, which has a plurality of spaced annular ridges therearound, is illustrated sealing seated against side walls 12*d*. Portions of 18*d* surround a first elevated cylindrical portion 18*f* which has relatively vertical side walls and a flat top portion. Portions of 18*f* surround a second cylindrical portion 18*g* which surrounds a first nipple 18*h*. Nipple 18*h* has relatively vertical side walls and a flat top portion and defines a central aperture 18*i* therethrough. A lower top interior relatively flat portion of 18*j* surrounds an elevated portion 18*k* which has essentially vertical side walls and a flat top portion. The top flat portion of 18*k* surrounds a second nipple 18L which is opposite nipple 18*h* and has relatively vertical side walls which become sloped. An aperture 18*m*, which has the same central axis as aperture 18*i*, extends through nipple 18L and meets aperture 18*i*. Nipples 18*h* and 18L** have a common central axis.

Filter assembly 20 has a cylindrical portion **20*a* whose outer diameter is slightly smaller than an inner diameter of the cylindrical body portion 18*b* of the dispenser plunger 18 and has a top portion 20*b* which is relatively flat and has a central aperture 20*c* therethrough and a plurality of other apertures 20*d* therethrough with filter material 20*e* covering apertures 20*d*. Filter material 20*e* is absolute hydrophobic and therefore renders air passing therethrough sterile. Aperture 20*c* is of slightly greater diameter than nipple 18L. The filter assembly 20 is adapted to fit inside dispenser plunger 18 and to have nipple 18L pass through central aperture 20b with part of top portion 20a of filter assembly 20 contacting the interior flat portion of 18k**.

Septum cap 24 is a cylindrical member having essentially vertical side walls 24a and a relatively flat top portion 24b having vent apertures 24c extending therethrough. Cap 24 has concentric first 24d, second 24e and third 24f recessed cylindrical portions extending into a bottom portion thereof. Vent apertures 24c pass through portions of cap 24 and couple to apertures 18e of dispenser plunger 18. A nipple 24g is centrally located within portion 24f and has a diameter which is smaller than the inner diameter of nipple 18h of dispenser plunger 18. Nipple 24g is adapted to fit into aperture 18i of nipple 18h.

Locking crown 22 comprises spaced apart flexible resilient finger portions 22a having first 22b and second 22c protrusions (nibs), an inner cylindrical wall portion 22d having an outer diameter which is somewhat less than the inner diameter of the upper chamber 12d, a circular flat top portion 22e which has spaced apart apertures 22f therethrough, and a cylindrical upper portion 22g which has a flat portion 22h that has a central aperture 22i therethrough and spaced apart apertures 22j. Nib 22b of finger portions 22a is adapted to selectively engage groove 12i of container 12 so as to mechanically interlock locking crown 22 and container 12 when locking crown 22 is in an upper position. Nib 22 of finger portions 22a is adapted to selectively engage groove 12i of container 12 so as to mechanically interlock locking crown 22 and container 12 when locking crown 22 is in an lower position. Cylindrical wall portion 22b is adapted top be inserted into upper chamber 12d. Apertures 22f are used so as to facilitate the fabrication of nib 22b.

Sealing disc 26 has a circular portion 26a, a tab portion 26b, and nipples 26c which are adapted to engage the apertures 24d of septum cap 24 and thereby seal off same.

Locking cap 28 is a cup-like cylindrical member having vertical side walls 28a and a flat circular top portion 28b. The inner diameter of cap 28 is selected such that it fits over sealing disc 26, septum cap 24 and the finger portions 22a of locking crown 22.

Shrink wrap 30 covers cap 28 and portions of outside walls of container 12 and sealingly adheres to both when heated.

Figure 2:
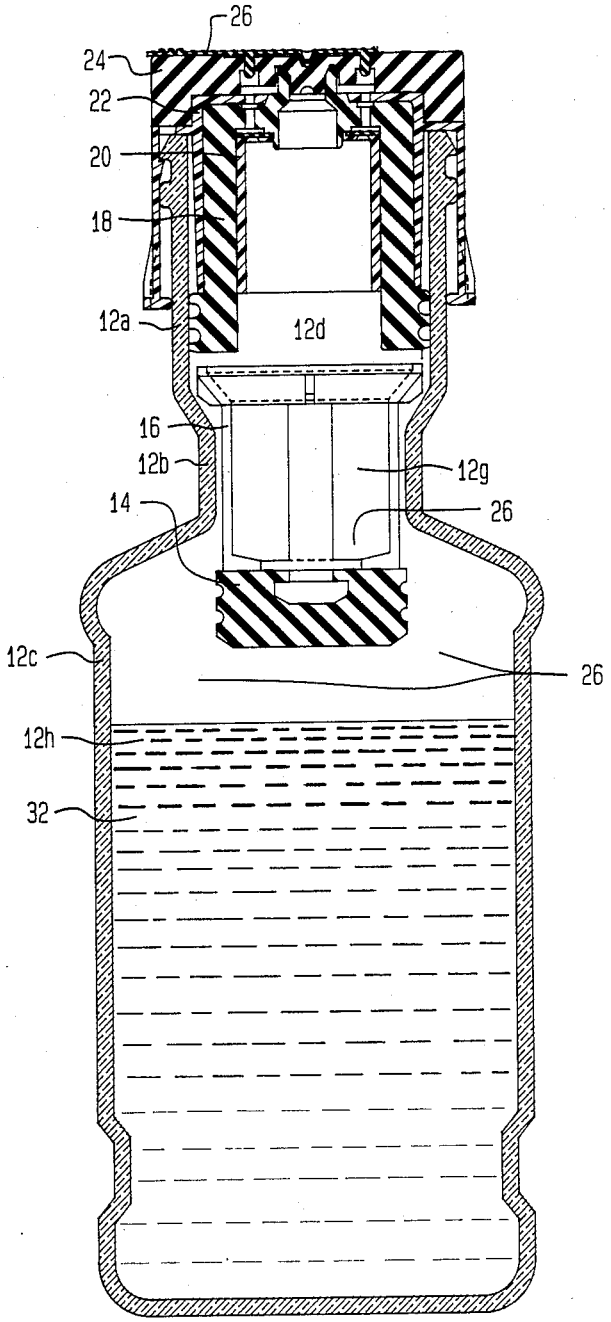
FIG. 2 illustrates a cross-sectional view of the embodiment of FIG. 1 with some components removed and with the position of some of the components modified.

Referring now to FIG. 2, there is illustrated a cross-sectional view of assembly 10 with shrink wrap 30 and locking cap 28 removed and with stopper 14, basket 16, dispenser plunger 18, filter assembly 20, locking crown 22, septum cap 24 and sealing disc 26 vertically displaced downward such that portions of basket 16 are in a portion of lower chamber 12h. Power 26 is illustrated entering lower chamber 12h where it mixes with liquid 32.

Figure 7:
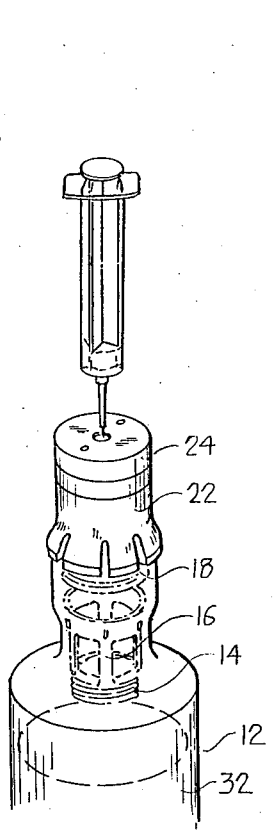
FIGS. 4, 5, 6 and 7 illustrate how to actuate and use the embodiment of FIGS. 1, 2, and 3.
Figure 6:
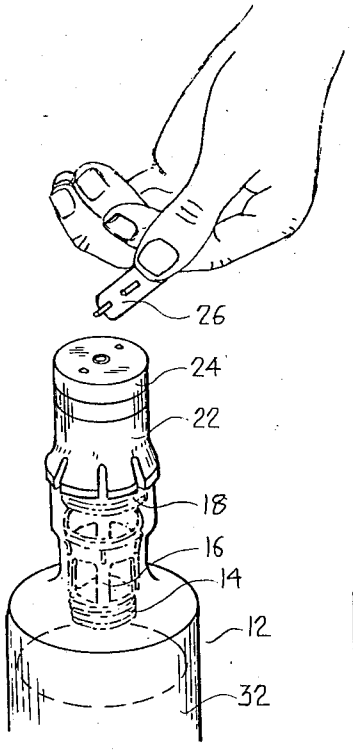
Figure 5:
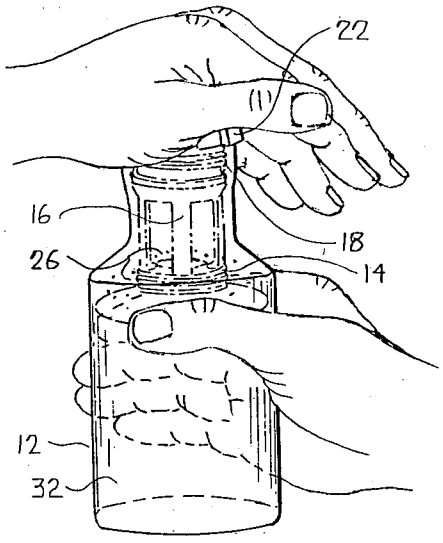
Figure 4:
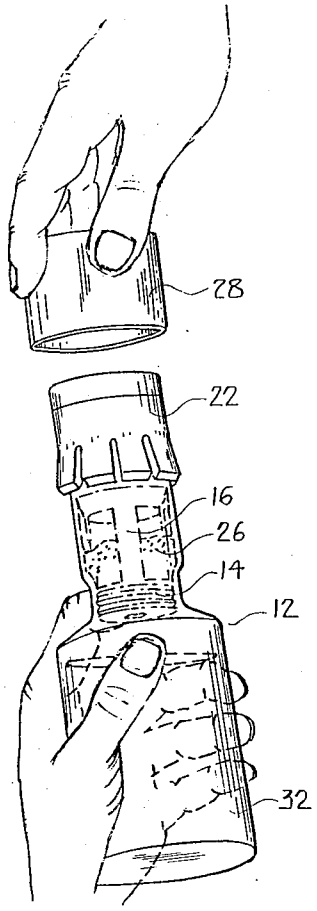

Referring now to FIGS. 4, 5, 6, and 7, there is illustrated the operation of apparatus 10. In FIG. 4 the shrink wrap 30 and locking cap 28 have both been removed. In FIG. 5, septum cap 24, sealing disc 26, locking crown 22, dispenser plunger 18, filter assembly 20, basket 16, and liquid stopper 14 are illustrated being displaced such that part of basket 16 and all of liquid stopper 14 are within lower chamber 12h. Power 26 is illustrated falling into lower chamber 12h and beginning to mix with liquid 32. Container 12 is now shaken to fully mix powder 26 with liquid 32. In FIG. 6 sealing disc 26 is illustrated being removed from septum cap 24. In FIG. 7 the needle tip of a syringe is inserted through a central portion of septum cap 24 and into upper chamber 12d. Container 12 is then inverted and the mixture is drawn from container 12 into a chamber of the syringe. As the mixture is drawn from container 12, air enters through the apertures in septum cap 24, locking crown 22, dispenser plunger 18, through the apertures and filter material in filter assembly 20 and into upper chamber 12d where it relieves the vacuum being created.

It is to be noted that the mixing operation is sterile since container 12 is sealed and since the preparer does not handle the powder or liquid which is preloaded into apparatus 10 by the manufacturer. The mixing procedure is sterile, very simple, relatively fast, and efficient. The dispensing operation is also sterile since air entering container 12 is effectively sterilized as it passes through filter material 20e of filter assembly 20. There can be no error as to which liquid and powder are to be mixed or as to the proper proportions of each.

In a preferred embodiment, which has been built and found to be fully functional, container 12 is glass, locking cap 28, sealing disc 26, filter assembly 20, and basket 16 are polyethylene, and septum cap 24, dispenser plunger 18, and liquid stopper 14 are butyl rubber. Filter assembly 20 uses a 2.5 micron absolute hydrophobic filter, Thiopental sodium in powder form is used as the powder and sterile water is used as the liquid. A mixture of thiopental sodium and water is instable and must be promptly used with unused portions discarded within 24 hours. Apparatus 10 allows thiopental sodium and water to be mixed in exactly the right proportions, in a sterile operation which is simple, efficient and fool proof.

It is to be noted that apparatus 10 can easily be used to dispense a mixture of a liquid and powder into a syringe which does not contain a needle or into an I.V. set-up. After the powder and liquid are mixed as is indicated hereinabove, the septum cap is removed and a luer tip of the syringe or a spike of the I.V. set-up is inserted into the center aperture of the dispensing plunger. The container and syringe or container and I.V. set-up are then inverted and the mixture is drawn into a chamber of the syringe or a bottle of the I.V. set-up. I.V. set-ups having either one or two lumen spikes may be used.

It is to be understood that the embodiments described herein are merely illustrative of the general principles of the invention. Various modifications are possible within the scope of the invention. For example, basket 16 can be replaced by a variety of other rigid or semi-flexible structures. Further, stopper 14 need not have annular spaced ridges as long as the diameter thereof in a relaxed state is slightly greater than the diameter of neck chamber 12g. Still further, dispenser plunger 18 need not have annular spaced ridges as long as the diameter thereof in a relaxed state is slightly greater than the diameter of upper chamber 12d. Furthermore, container 12 can have an upper chamber and a lower chamber but no neck chamber. The upper chamber would have a smaller cross-sectional area than the lower chamber and stopper 14 would form a sealing engagement with the side walls of a lower portion of the upper chamber and during a mixing operation it would be displaced into the lower chamber. Further, basket 12 need not have the male coupling member. This would allow the stopper to fall into the lower chamber during the mixing operation. Still further, the structure and location of the filter assembly can be changed. Further, the powder can be replaced with a solid and the structure of the basket can be modified to allow the solid to drop into the liquid when the stopper is forced into the lower chamber. Typically solids dissolve in liquids more slowly than powders do and therefore it may take longer for the solid to dissolve into the liquid. A solid could be substituted for the powder even without a change in the structure of the basket. Under such conditions the bottle could be turned upside down after the stopper is in the lower chamber and the solid would dissolve into the liquid. Furthermore, a first ingredient from the group of a liquid, a solid, or a powder, could be placed in the upper chamber and a second ingredient from the same group could be placed in the second chamber such that any combination of two of the three ingredients can by stored in the bottle and then subsequently mixed.

What is claimed is:

1. An apparatus comprising a container including first and second chambers which are adapted to house a liquid and a solid, respectively, first sealing means fabricated from a resiliently flexible material for forming a sealing engagement with an internal surface of the container intermediate the first and second chambers so as to form a barrier between the chambers, a dispenser plunger means comprising sequentially in the upward vertical direction:

a second sealing means portion fabricated from a resiliently flexible material;

a hollow substantially cylindrical body portion; and a substantially flat top portion; and wherein said second sealing means portion of said dispenser plunger forms a sealing engagement with an internal surface of the container intermediate the second chamber and a peripheral space external to the container; and wherein a transmitting means comprising a collar portion is adapted to selectively contact the underside of said second sealing means portion to transmit force applied from said dispenser plunger means to said first sealing means, whereby the first sealing means can be displaced into the first chamber so as to allow the two chambers to communicate one with the other and thus allow a mixing of said solid which is housed in the second chamber with said liquid which is housed in the first chamber, and wherein following said mixing, the dispenser plunger permits the sterile withdrawal of mixed solution through its top portion without unsealing said second sealing means.

2. The apparatus of claim 1 wherein the solid is a powder.

3. The apparatus of claim 2 wherein the second chamber has a cross-sectional area which is greater than the cross-sectional area of the first chamber.

4. The apparatus of claim 1, wherein the transmitting means comprises a basket.

5. The apparatus of claim 4 wherein said basket has top and bottom portions and is adopted to fit between said first and second cylindrical sealing means.

6. The apparatus of claim 5 wherein the dispenser plunger, which is a cylindrical member, comprises a centrally located nipple which extends through both sides of a top portion thereof, said nipple having side walls which define a central aperture therethrough; and the top portion of the dispenser plunger also defines a first plurality of apertures therethrough in addition to the aperture through the nipple.

7. The apparatus of claim 6 where the basket is adapted to be coupled to the sealing means.

8. The apparatus of claim 7 further comprising a filter assembly having a top portion which defines a central aperture therethrough and a plurality of other apertures therethrough which are covered by filtering material; and the filter assembly being adapted to be in contact with the dispenser plunger such that part of the nipple of the dispenser plunger extends through the central aperture of the filter assembly and the other apertures of the filter assembly are in communication with the apertures of the dispenser plunger through the filter material;

9. The apparatus of claim 8 further comprising a locking crown having a cylindrical inner structure which is adapted to fit over the dispenser plunger and having a top structure which defines apertures therethrough which are in communication with the apertures of the dispenser plunger when the locking crown is fit over the dispenser plunger; and the locking crown having an outer portion which comprises finger-like members which are adapted to engage a groove which is part of the outer surface of the container.

10. The apparatus of claim 9 further comprising a septum cap whose structure defines apertures therethrough; and the apertures of the septum cap being in communication with the apertures of the locking crown when the septum cap is placed on top of the locking crown

11. The apparatus of claim 10 further comprising:

a sealing disc having a plurality of nipples which are equal in number to the number of apertures in the septum cap, the nipples of the sealing disc being located so as to fit into and seal off the apertures of the septum cap when the sealing cap is placed on the septum cap; and the sealing cap having a tab portion which facilitates removal of the sealing disc from the septum cap.

12. The apparatus of claim 11 further comprising a locking cap which is cup-like and covers the septum cap, sealing disc and locking crown.

13. The apparatus of claim 12 further comprising shrink wrap which covers the locking cap and part of an outside surface of the container.

14. The apparatus of claim 1 wherein said first and second sealing means are in a disconnected relationship before mixing.

15. The apparatus of claim 1, wherein said transmitting means is in a disconnected relationship with respect to said second sealing means before mixing.

16. The apparatus of claim 1, wherein said transmitting means is fabricated of less resiliently flexible material than said first or second sealing means.

* * * * *